US008429094B2

(12) United States Patent
Farlotti

(10) Patent No.: US 8,429,094 B2
(45) Date of Patent: Apr. 23, 2013

(54) METHOD OF FRANKING AS A FUNCTION OF MAIL CATEGORY

(75) Inventor: Laurent Farlotti, Pruniers (FR)

(73) Assignee: Neopost Technologies, Bagneux (FR)

( * ) Notice: Subject to any disclaimer, the term of this patent is extended or adjusted under 35 U.S.C. 154(b) by 563 days.

(21) Appl. No.: 12/465,339

(22) Filed: May 13, 2009

(65) Prior Publication Data

US 2009/0299917 A1 Dec. 3, 2009

(30) Foreign Application Priority Data

Jun. 3, 2008 (FR) ..... 08 53655

(51) Int. Cl.
*B65B 35/00* (2006.01)

(52) U.S. Cl.
USPC ..... 705/406

(58) Field of Classification Search ..... 705/406
See application file for complete search history.

(56) References Cited

U.S. PATENT DOCUMENTS 6,321,214 B1 * 11/2001 Thiel ..... 705/408
6,321,241 B1 * 11/2001 Gartung et al. ..... 715/210
2002/0198852 A1 12/2002 Freeman et al.
2005/0065896 A1 * 3/2005 Kummer et al. ..... 705/401
2008/0262978 A1 * 10/2008 Collings et al. ..... 705/401
2008/0313104 A1 * 12/2008 Pintsov ..... 705/402

FOREIGN PATENT DOCUMENTS

EP 1 450 310 A1 8/2004
EP 1 777 660 A1 4/2007
FR 2 881 549 A1 8/2006
WO 2004/021287 A1 3/2004

* cited by examiner

*Primary Examiner* — John Hayes
*Assistant Examiner* — David J Clark
(74) *Attorney, Agent, or Firm* — Sughrue Mion, PLLC

(57) ABSTRACT

A method of franking mailpieces including the following steps: an operator loads a mailpiece on a feed deck of the machine; the width of the mailpiece is determined automatically by a plurality of presence detectors mounted on the feed deck; the length of the mailpiece is estimated by a processor, on the basis of the width of the mailpiece; an initial franking amount to be applied to the mailpiece is computed by the processor; the mailpiece is extracted automatically from the feed deck, and a postal imprint is printed; the real length of the mailpiece is determined; the real length is compared with the previously estimated length; if these two lengths do not match, an audible or visible alarm is generated by a warning device; the processor computes a corrected franking amount; and a new postal imprint making it possible to correct the initial franking amount is printed.

11 Claims, 2 Drawing Sheets

METHOD OF FRANKING AS A FUNCTION OF MAIL CATEGORY

The present invention relates to the field of mail handling. It relates in particular to a method of franking mailpieces by means of a franking system.

PRIOR ART

Nowadays, prices for carrying mailpieces are based not only on weight and service criteria, but also on the format (thickness, length, and width) of the mailpiece sent. This involves in particular checking whether the dimensions of an envelope or of a parcel are greater than thresholds (e.g. the "letter", "large letter", and "packet" thresholds in the "Pricing-in-Proportion" or "PiP" system of the British postal authority regulations).

Currently, in order to assign the appropriate price automatically to each mailpiece in a non-uniform batch, a device for measuring the weight and the dimensions of each envelope is placed upstream from the franking module or "postage meter" of a mail-handling machine, in general at the feed module or "feeder" thereof, and the resulting information is transmitted to a price computer. The weight can also be measured separately by means of an independent weigh module placed in the path along which the envelopes are conveyed, e.g. between the feeder and the franking module. An example of such a device is given in U.S. Pat. No. 7,098,410 filed in the name of the Applicant.

Unfortunately, bottom-of-range franking machines do not have such an automatic feed device that is both complex and costly, but rather they have merely a deck not equipped with any measurement device and on which the mailpieces that are to be driven towards the franking module are placed one-by-one. Therefore, in order to compute the appropriate amount of franking or postage, it is necessary for the format of each mailpiece to be input first at the user interface of the franking module, thereby considerably limiting the franking throughput rate of such bottom-of-the-range machines.

OBJECTS AND DEFINITION OF THE INVENTION

An object of the present invention is thus to propose a method of franking that automatically takes into account the measurement of the format (length, width, thickness) of a mailpiece without it being necessary to use complex or costly systems for taking that measurement. An object of the invention is also to propose a method that is particularly suited to franking non-standard mailpieces.

The invention achieves these objects by means of a method of franking mailpieces in a franking machine, wherein said method comprises the following steps:

- a mailpiece loading step in which an operator loads a mailpiece on a feed deck of said franking machine;
- a width determination step in which the width of the mailpiece is determined automatically by a plurality of presence detectors mounted on said feed deck perpendicularly to a longitudinal wall for referencing the mailpiece;
- a mail category estimation step in which the mail category to which the mailpiece belongs is estimated by processor means of said franking machine, on the basis of said width of the mailpiece;
- an initial franking amount computation step in which an initial franking amount to be applied to said mailpiece is computed by said processor means;

- a mailpiece extraction and printing step in which the mailpiece is extracted from said feed deck, and a postal imprint including said initial franking amount is printed by print means of said franking machine;
- a real length determination step in which the real length of the mailpiece is determined by length measurement means of said franking machine;
- a comparison step in which said processor means compare the previously estimated mail category with a mail category determined on the basis of said real length of the mailpiece;
- if these two mail categories are not identical, an alarm generating step in which an audible or visible alarm is generated by a warning device of said franking machine;
- a corrected franking amount computation step in which said processor means compute a corrected franking amount; and
- a new postal imprint printing step in which a new postal imprint making it possible to correct the initial franking amount is printed.

Thus, without using complex and therefore costly means for determining format, the method of the invention enables the franking amounts to be computed automatically for standard mailpieces, and, by means of a second printing operation enabling an initial franking amount to be corrected, also enables non-standard mailpieces to be passed.

Said mailpiece extraction step may be performed automatically after the operator has validated the initial franking amount previously displayed on said franking machine, and the method may further comprise a corrected franking amount display step in which said corrected franking amount is displayed on said franking machine.

Advantageously, prior to the computation of the initial franking amount, the method of the invention further comprises a mailpiece weigh step in which the mailpiece is weighed by a weigh device, and a thickness measurement step in which the thickness of the mailpiece is measured by a thickness measurement device, which thickness measurement step may be continued throughout the advance of said mailpiece through said franking machine, so as to determine a maximum thickness of the mailpiece.

Preferably, when said maximum thickness value is greater than a maximum thickness value for the mail category in question, an audible or visible alarm is generated by a warning device of said franking machine, and a corrected franking amount is computed by said processor means.

Depending on the implementation, the method may further comprise a mailpiece reloading and printing step in which the operator reloads the franked mailpiece onto said feed deck, and said new postal imprint is printed on said mailpiece for a franking amount corresponding to the difference between the corrected franking amount and the erroneous initial franking amount, or the method may further comprise a label loading and printing step in which a label is loaded, and said new postal imprint is printed on said label for a franking amount corresponding to the difference between the corrected franking amount and the erroneous initial franking amount, or merely equal to the corrected franking amount, said label then being stuck on said mailpiece bearing the erroneous initial franking amount.

BRIEF DESCRIPTION OF THE DRAWINGS

Other characteristics and advantages of the invention appear from the following description of particular implementations, given by way of non-limiting example, and with reference to the accompanying drawings, in which.

DETAILED DESCRIPTION OF PREFERRED IMPLEMENTATIONS

Figure 1:
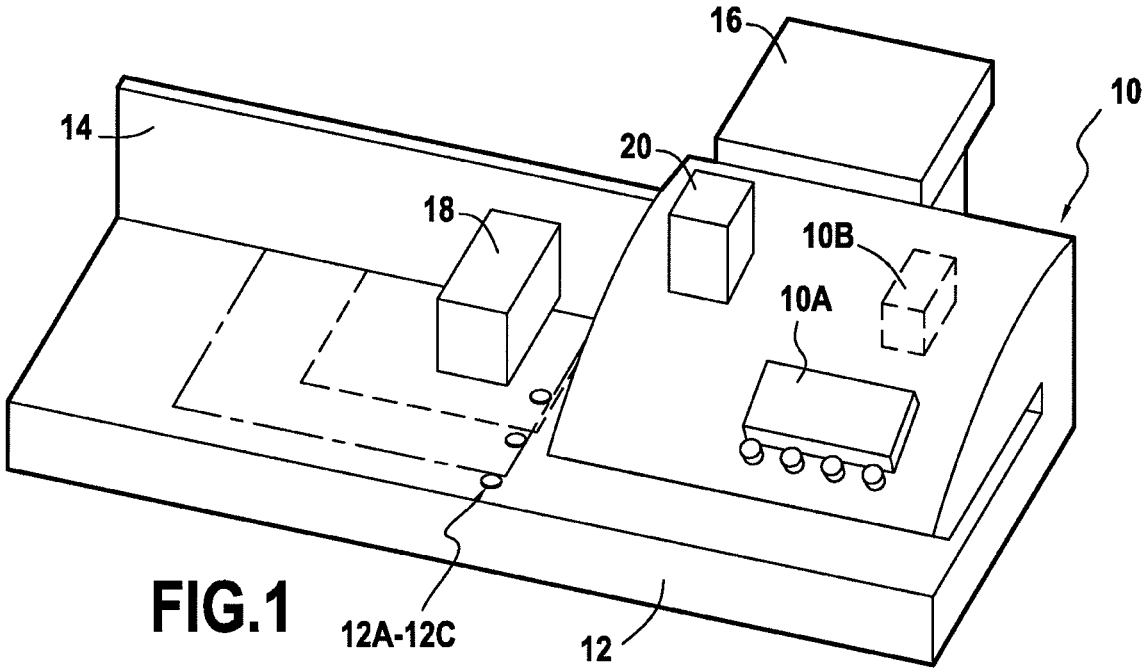
FIG. 1 is a perspective view, for various formats of mailpiece, of a franking machine implementing the franking method of the invention.

FIG. 1 is a perspective view of a franking machine implementing the mailpiece franking method of the invention. Conventionally, such a machine that is designed to print on mailpieces one-by-one has print means 10, typically constituted by an ink jet print head, for printing the postal imprint on the mailpiece, a feed deck 12 provided with a longitudinal referencing wall 14 and for feeding the print means with mailpieces. An external collection tray (not shown) can be provided for receiving the mailpieces once they have been franked by the print means. Naturally, said machine has a user interface 10A for inputting the postal data necessary for determining the amount of franking (class of weight, geographical zone of destination, services requested, etc.), and secure processor means 10B containing, inter alia, franking account data, in particular up-counters and down-counters, and reset credit data. It can also have means for connection to a remote server (not shown) that then makes it a communicating machine, in particular for resetting credit and for sending postal statistics.

An external weigh device 16 delivering the weight of the mailpiece that is then to be placed on the deck prior to being franked is also provided. This weigh device is naturally in communication with the franking machine so as to communicate thereto the resulting weight value.

For implementing the method of the invention, a thickness measurement device 18 is provided that extends over and across a fraction of the feed deck from the referencing wall 14, and that, for example, has a presser member that acts on the top face of the mailpiece and that can move vertically as the mailpiece advances depending on the thickness of said mailpiece. In addition, disposed on a common line perpendicular to the wall 14 for referencing the mailpieces, the feed deck has a plurality of presence detectors (or sensors) 12A-12C, each of which is connected to the secure processor means 10B, the respective predetermined positions of said presence detectors relative to said referencing wall serving, by defining a range of widths for a mailpiece placed on the feed deck, to determine an estimation of the mail category to which said mailpiece belongs, which estimation is then confirmed or otherwise by a measurement of the real length of the mailpiece, as described in more detail below. These individualized presence detectors can be of any type making it possible to detect the mailpiece on the deck, such as optical sensors, mechanical sensors, ultrasound sensors, etc.

Thus, in the example shown, corresponding to use of the machine for US regulations, the first sensor 12A that is closest to the referencing wall and that is disposed at a distance of 88.9 millimeters (mm) therefrom makes it possible to detect a mailpiece corresponding to the minimum US postcard format, the second sensor 12B that is disposed at a distance of 108 mm makes it possible to detect a mailpiece corresponding to the maximum US postcard format, and the third sensor 12C that is disposed at a distance of 155.6 mm makes it possible to detect a mailpiece corresponding to the maximum US letter format.

Naturally, these positions corresponding to the limit width values defining determined categories of mailpiece differ as a function of the postal regulations in question. However, it is possible to provide positions that enable the detectors to be made compatible with two sets of postal regulations at the same time, such as the US and the British postal regulations. More particularly, in a preferred embodiment, the individualized detectors can be replaced with a single strip of light-emitting diodes (LEDs (not shown)) disposed perpendicularly to the referencing wall, in order to enable the machine to be adapted to accommodate all of the existing postal regulations, thereby making the machine more universal.

Figure 2:
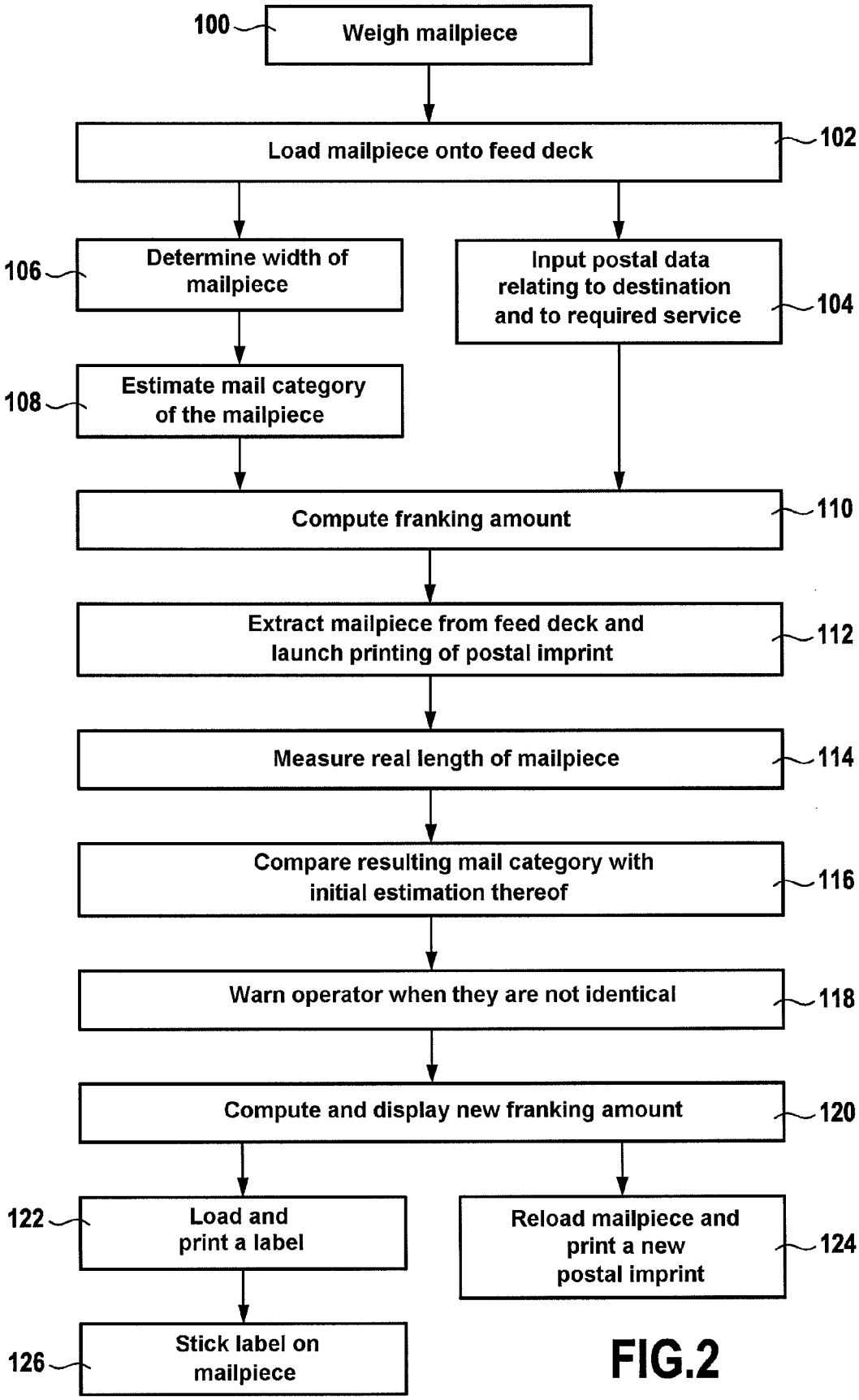
FIG. 2 shows the various steps making it possible to frank a non-standard mailpiece by using the machine of FIG. 1.

The franking method of the invention is described below with reference to the flow chart of FIG. 2.

With the machine being initialized with the applicable postal regulations on being switched on, the operator can then perform franking operations one-by-one on the mailpieces in the operator's possession. In a first step 100, the mailpiece is, in principle, weighed on the weigh device 16, and the corresponding weight value is sent to the processor means 10B (however, this step is not essential if the mailpieces to be handled do not all have the same weight), then, in a step 102, the mailpiece is loaded (placed) on the feed deck 12 under the presser member of the thickness measurement device 18 (which device delivers a first measurement of the thickness to the processor means 10B) and against the referencing wall 14 so as to cover a fraction of the line of the presence detectors 12A-12C, and the operator, in a step 104, inputs the geographical destination code for the mailpiece and optionally the requested service (as well as the weight if said weight has not been delivered automatically by the weigh device).

In parallel with that inputting, the mailpiece being received on the feed deck launches the process of computing the franking amount, by determining, in a step 106, only the width (more exactly a width range) of the mailpiece, as given by the state (covered or uncovered) of the presence detectors. In general, since mailpiece formats are standardized, it is possible, for a given width, to estimate the probable length of the mailpiece and thus to deduce therefrom, once its thickness is known, the category of mail to which a mailpiece belongs. This is what is done in a step 108, in which, at the processor means 10B, an estimate is made of the mail category to which the mailpiece belongs on the basis of the preceding evaluation of its width and of the knowledge of its initial thickness. The franking amount is then computed automatically, in a step 110, as a function of said estimate and of the postal data input or determined previously, and, once this computing is finished, the mailpiece is, in a step 112, extracted automatically from the feed deck so as to launch the franking process (printing of the postal imprint) at the print means 10 (it is also possible to make provision for the extraction process to be launched manually by the operator by validating the franking amount displayed on the user interface of the machine).

The print process is synchronized, as is known, when the mailpiece enters the franking machine, on the basis of detection of the leading edge of said mailpiece, e.g. by a conventional lever detector or optical detector (not shown) that, in the context of the present invention, also makes it possible, in a step 114, to measure the real length of the mailpiece, this measurement being obtained once the leading edge and the trailing edge of the mailpiece have gone past said detector. The measured real length of the mailpiece can then, in a following step, be compared with the length estimated previously on the basis of the width of the mailpiece (step 116), and an alarm generated by an audible or visible warning device on the user interface 10A is then given to the operator, in a step 118, when the estimated mail category and the actually determined mail category do not match, thereby indicating to the operator that the mailpiece needs to undergo a second print process. It can be noted that such a category mismatch arises mainly in the presence of non-standard mailpieces, and therefore relatively infrequently in practice. However, since the postal imprint is a monetary value, an erroneous franking amount that is a source of financial losses and of rejection by the postal authority, cannot be tolerated.

It should also be noted that, since the device 18 for measuring the thickness of the mailpiece generates thickness values throughout the advance of the mailpiece, it is possible for the maximum thickness of said mailpiece to be greater than the static thickness value obtained initially on reception of the mailpiece, and for erroneous computation of the franking amount to ensue (this is possible if the thickness variation gives rise to a change of mail category). In which case, an audible or visible alarm is also generated for the operator so as to inform the operator that the mailpiece needs to undergo a second print process.

Figure 3:
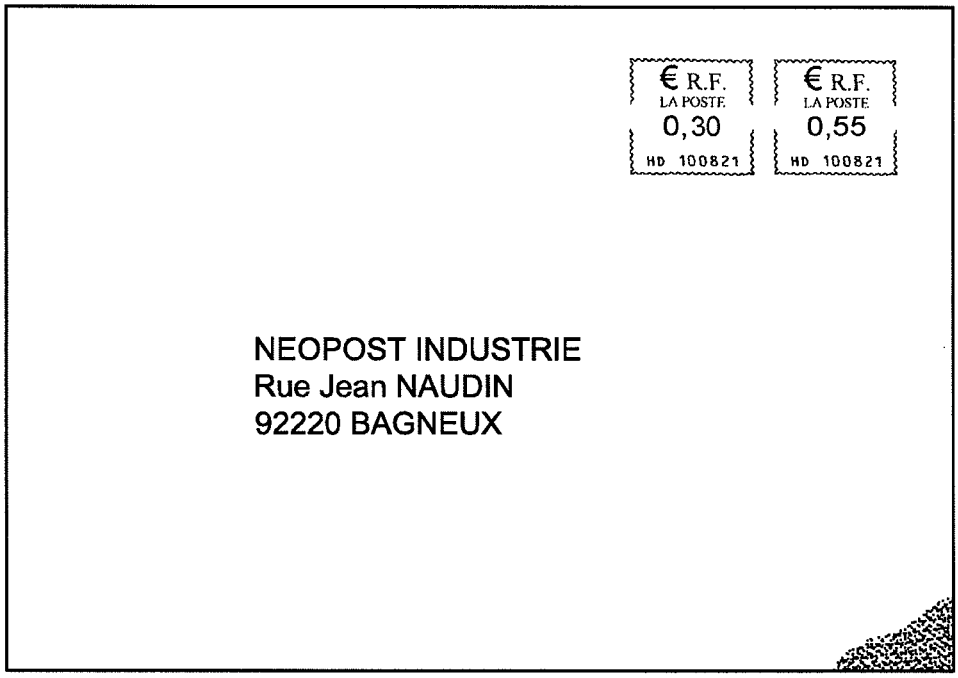
FIG. 3 shows a mailpiece in an implementation of the method of the invention.

In a step 120, the processor means then automatically compute the corrected franking amount and, if possible, display it on the user interface, and it is optionally proposed to the operator either to print a label with said corrected amount, or to print a new postal imprint with a franking amount corresponding to the franking supplement necessary to obtain the corrected amount by topping up the initially printed erroneous amount. Depending on the choice made by the operator, when the operator is given such a choice (it can be decided for a label to be printed systematically), in a step 122, a label is loaded (manually or automatically by means of an integrated label dispenser 20), and the corrected amount is printed on said label, or, in an alternative step 124, the mailpiece is re-loaded and a new postal imprint with the computed franking supplement is printed alongside and preferably behind the initial postal imprint, as shown in FIG. 3. When a label is printed, the operator must, in a final step 126, stick the label over the initial postal imprint whose amount it corrects. Naturally, during this second pass, the weight and the thickness of the mailpiece are not measured again, and nor is the real length thereof.

Thus, by implementing the dual printing method of the invention, it is possible, with a very low cost franking machine, and thus with a franking machine that is not equipped with a complex device for automatically determining format, nevertheless to compute franking amounts automatically regardless of the format of the mailpieces, and even with non-standard mailpieces.

The franking machine implementing the method of the invention is thus particularly suited to franking small numbers of mailpieces (a few tens of franking operations per day), and, by means of its simplified and robust structure, it can be implemented in a variety of environments, not only office automation environments, but also industrial or commercial environments.

What is claimed is:

1. A method of franking mailpieces in a franking machine, wherein said method comprises the following steps:

a mailpiece loading step in which an operator loads a mailpiece on a feed deck of said franking machine;

a width determination step in which the width of the mailpiece is determined automatically by a plurality of presence detectors mounted on said feed deck perpendicularly to a longitudinal wall for referencing the mailpiece;

a mail category estimation step in which the mail category to which the mailpiece belongs is estimated by processor means of said franking machine, on the basis of said width of the mailpiece;

an initial franking amount computation step in which an initial franking amount to be applied to said mailpiece is computed by said processor means;

a mailpiece extraction and printing step in which the mailpiece is extracted from said feed deck, and a postal imprint including said initial franking amount is printed by print means of said franking machine;

a real length determination step in which the real length of the mailpiece is determined by length measurement means of said franking machine;

a comparison step in which said processor means compare the previously estimated mail category with a mail category determined on the basis of said real length of the mailpiece;

if these two mail categories are not identical, an alarm generating step in which an audible or visible alarm is generated by a warning device of said franking machine;

a corrected franking amount computation step in which said processor means compute a corrected franking amount; and a new postal imprint printing step in which a new postal imprint making it possible to correct the initial franking amount is printed.

2. A method according to claim 1, wherein said mailpiece extraction step is performed automatically after the operator has validated the initial franking amount previously displayed on said franking machine.

3. A method according to claim 1, further comprising a corrected franking amount display step in which said corrected franking amount is displayed on said franking machine.

4. A method according to claim 1, wherein, prior to the computation of the initial franking amount, said method further comprises a mailpiece weigh step in which the mailpiece is weighed by a weigh device.

5. A method according to claim 1, wherein, prior to computation of the initial franking amount, said method further comprises a thickness measurement step in which the thickness of the mailpiece is measured by a thickness measurement device.

6. A method according to claim 5, wherein said thickness measurement step is performed throughout the advance of said mailpiece through said franking machine, so as to determine a maximum thickness of the mailpiece.

7. A method according to claim 6, wherein, when said maximum thickness value is greater than a maximum thickness value for the mail category in question, an audible or visible alarm is generated by a warning device of said franking machine, and a corrected franking amount is computed by said processor means.

8. A method according to claim 1, further comprising a mailpiece reloading and printing step in which the operator reloads the franked mailpiece onto said feed deck, and said new postal imprint is printed directly on said mailpiece for a franking amount corresponding to the difference between the corrected franking amount and the initial franking amount which is erroneous.

9. A method according to claim 1, further comprising a label loading and printing step in which a label is loaded, and said new postal imprint is printed on said label for a franking amount corresponding to the difference between the corrected franking amount and the initial franking amount which is erroneous.

10. A method according to claim 1, further comprising a label loading and printing step in which a label is loaded, and said new postal imprint is printed on said label for a franking amount corresponding to the corrected franking amount.

11. A method according to claim 9, further comprising a label-sticking step in which said label is stuck on said mail-piece bearing the initial franking amount which is erroneous.

* * * * *